US006949054B1

(12) United States Patent
Stearns et al.

(10) Patent No.: US 6,949,054 B1
(45) Date of Patent: Sep. 27, 2005

(54) EXERCISE METHODS AND APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 10/876,243

(22) Filed: Jun. 23, 2004

Related U.S. Application Data

(60) Provisional application No. 60/483,509, filed on Jun. 26, 2003.

(51) Int. Cl.[7] ..... A63B 22/00; A63B 69/16
(52) U.S. Cl. ..... 482/52; 482/57
(58) Field of Search ..... 482/51–53, 57, 482/70, 79–80

(56) References Cited

U.S. PATENT DOCUMENTS

| | | | | |
|---|---|---|---|---|
| 5,433,680 | A * | 7/1995 | Knudsen | 482/57 |
| 5,893,820 | A * | 4/1999 | Maresh et al. | 482/51 |
| 5,924,963 | A * | 7/1999 | Maresh et al. | 482/57 |
| 6,168,552 | B1 * | 1/2001 | Eschenbach | 482/52 |
| 6,254,514 | B1 * | 7/2001 | Maresh et al. | 482/52 |
| 6,398,695 | B2 * | 6/2002 | Miller | 482/52 |
| 6,482,132 | B2 * | 11/2002 | Eschenbach | 482/52 |

* cited by examiner

*Primary Examiner*—Stephen R. Crow

(57) ABSTRACT

An exercise device has left and right foot supports that are supported on respective pairs of pivoting rails that are constrained to remain parallel to one another. Left and right cranks move the rails relative to a frame, and move the foot supports along the rails in a manner that defines adjacent paths of generally elliptical foot motion, while maintaining the foot supports in a fixed orientation relative to the frame.

3 Claims, 1 Drawing Sheet

EXERCISE METHODS AND APPARATUS WITH ELLIPTICAL FOOT MOTION

CROSS-REFERENCE TO RELATED APPLICATION

Figure 1:
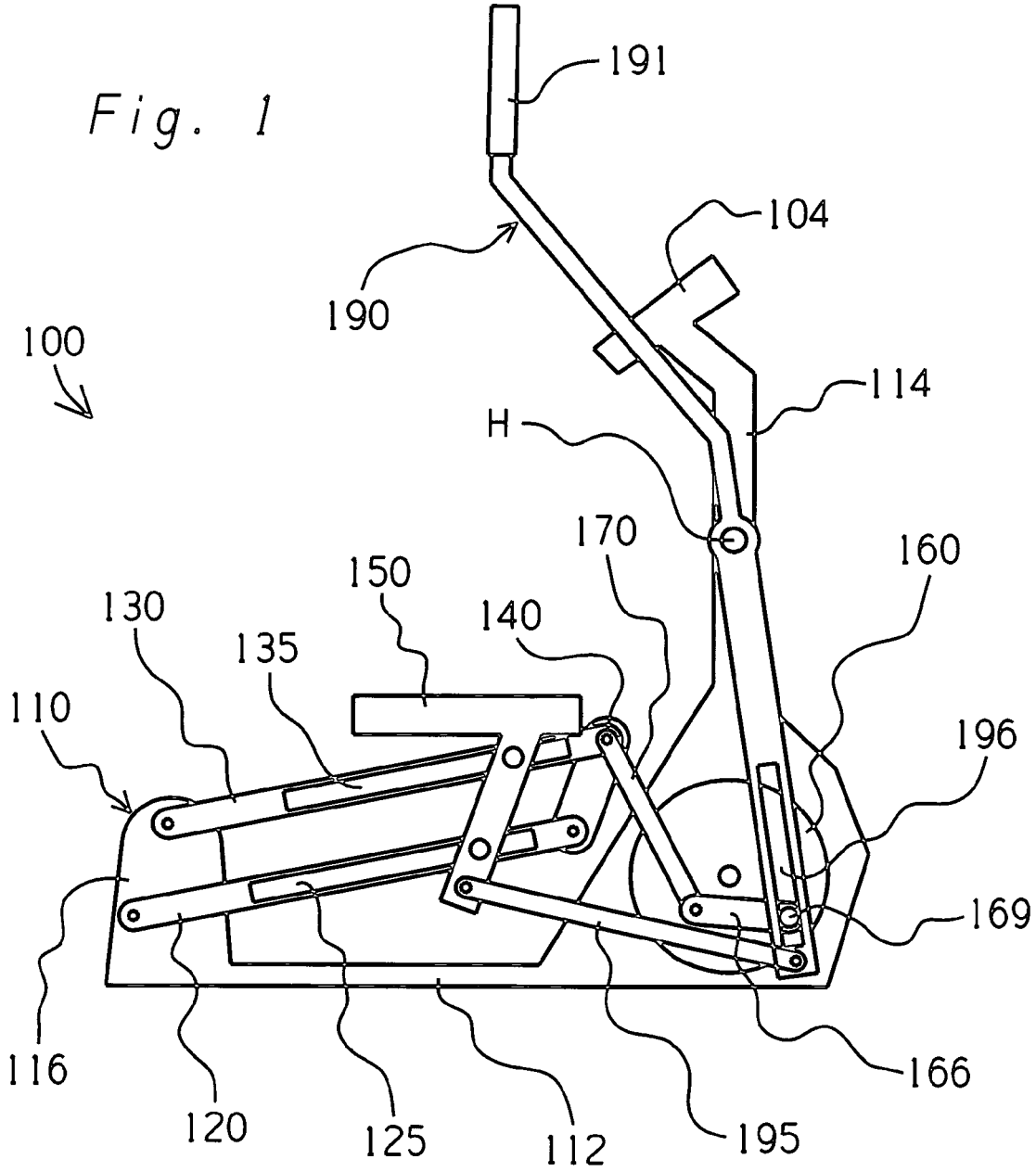

Disclosed herein is material that is entitled to the filing date of U.S. Provisional No. 60/483,509, filed on Jun. 26, 2003.

FIELD OF THE INVENTION

The present invention relates to exercise methods and apparatus, and more specifically, to machines that guide a person's feet through elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; and U.S. Pat. No. 5,882,281 to Stearns et al.

The foregoing examples of elliptical exercise equipment have foot supports that change orientation during exercise activity. To the contrary, an object of the present invention is to facilitate elliptical foot motion in a manner that maintains the foot supports in a constant orientation.

SUMMARY OF THE INVENTION

Generally speaking, the present invention provides a novel linkage assembly and corresponding exercise apparatus suitable for generating generally elliptical foot motion. The present invention may be described in terms of an exercise apparatus having left and right foot supports movably supported by respective left and right pairs of rails pivotally mounted on a frame and constrained to remain parallel to one another. Left and right cranks are connected to respective rails and respective foot supports in a manner that moves both the rails relative to the frame and the foot supports relative to respective rails, while maintaining the foot supports in a constant orientation relative to the frame. Many features and advantages of the present invention will become apparent to those skilled in the art from the more detailed description that follows.

BRIEF DESCRIPTION OF THE FIGURE OF THE DRAWING

With reference to the FIGURE of the Drawing,

FIG. 1 is a side view of an elliptical motion exercise device constructed according to the principles of the present invention, showing the frame and the near side of a linkage assembly movably mounted on the frame.

DETAILED DESCRIPTION OF A PREFERRED EMBODIMENT

A preferred embodiment exercise machine constructed according to the principles of the present invention is designated as 100 in FIG. 1. The exercise machine 100 generally includes a frame 110; left and right linkage assemblies movably mounted on the frame 110; and a user interface 104 mounted on the frame 110. The interface 104 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The machine 100 is generally symmetrical about a vertical plane extending lengthwise through the center of the frame 110. For ease of illustration, FIG. 1 shows only the right side linkage assembly, with the understanding that a similar left side linkage assembly is disposed on the left side of the machine (preferably one hundred and eighty degrees out of phase relative to the right side). Also, to the extent that reference is made to forward or rearward portions of a machine 100, it is to be understood that a person could exercise while facing in either such direction relative to the disclosed linkage assembly.

The frame 110 includes a floor engaging base 112; a forward stanchion 114 that extends upward from the base 112 proximate the front end of the frame 110; and a rearward stanchion 116 that extends upward from the base 112 proximate the rear end of the frame 110. An upper end of the forward stanchion 114 is configured to support the user interface 104, and may be configured to support additional items, including a water bottle, for example.

Each linkage assembly includes first and second rails 120 and 130 having rearward ends that are pivotally connected to respective portions of the rearward stanchion 116, thereby defining first and second rear pivot axes. Opposite, forward ends of the rails 120 and 130 are pivotally connected to respective portions of respective floating links 140, thereby defining respective first and second forward pivot axes. On each side of the machine 100, the distance between the two forward pivot axes is equal to the distance between the two rearward pivot axes, and the distance between the two pivot axes associated with the first rail 120 is equal to the distance between the two pivot axes associated with the second rail 130. In other words, the rails 120 and 130 cooperate with respective floating links 140 and the frame 110 to define respective four bar linkages having opposing links that remain parallel to one another. As a result of this arrangement, the floating links 140 are constrained to move through respective arcuate paths while remaining in a fixed orientation relative to the frame 110.

On each side of the machine 100, a foot support or skate 150 is movably mounted on respective rails 120 and 130. Rollers or bearings are preferably disposed between each foot support 150 and respective rails 140 to facilitate a smooth gliding interface therebetween. On the preferred embodiment, for example, each skate 150 has a lower roller that is constrained to roll along a track 125 defined by a respective lower rail 120, and each skate 150 has an upper roller that is constrained to roll along a track 135 defined by a respective upper rail 130. The rollers are disposed the same distance apart as the forward pivot axes, thereby constraining the foot supports 150 to remain in a fixed orientation relative to the floating links 140, and thus, the frame 110.

On each side of machine 100, a crank 160 is rotatably mounted on the frame 110 at or near the forward stanchion 114. Each crank 160 may be described in terms of a first effective crank arm that is pivotally connected to one end of a drawbar link 170, and a second effective crank arm that is movably connected to the lower end of a handlebar rocker link 180. A crank link 166 has a first end that is rigidly connected to the crank 160 at the first crank arm, and an opposite second end that defines the second crank arm at an axially outboard location relative to the first crank arm.

An opposite end of each drawbar 170 link is pivotally connected to a portion of a respective four bar linkage that moves relative to the frame 110 (in this case, at the forward pivot axis defined between the upper rail 130 and the floating link 140). In other words, the drawbar links 170 link rotation of respective cranks 160 to pivoting of respective rails 120 and 130, and/or may be described as means for moving respective rails 120 and 130 relative to the frame 110.

An upper end 191 of each handlebar rocker link 190 is sized and configured for grasping. An intermediate portion of each handlebar rocker link 190 is pivotally connected to the forward stanchion 114 at a common pivot axis H. A respective roller is rotatably mounted on each second crank arm, and is disposed inside a respective race 196 provided in the lower end of a respective handlebar rocker link 190. On each side of the machine 100, an intermediate link 195 is pivotally interconnected between the lower distal end of a respective handlebar rocker link 190 and a respective foot support 150. As a result of this arrangement, rotation of the cranks 160 is linked to pivoting of the handles 191, and to movement of the foot supports 150 along respective rails 120 and 130.

Other means for moving the foot supports 150 along the rails 120 and 130 may be substituted for the foregoing arrangement. For example, substitute intermediate links (similar to the links 195) may have forward ends that are directly connected to the crank extensions 166, which in turn, may be adjusted to define relatively longer effective crank arms, if desired. Generally speaking, the larger the effective crank radius on this alternative embodiment, the greater the horizontal displacement of the foot supports 150.

The combined movements of the rails 120 and 130 relative to the frame 110, and the foot supports 150 relative to the rails 120 and 130 results in a generally elliptical path of motion for the foot supports 150 relative to the frame 110. As used herein, the term "elliptical" is intended in a broad sense to describe a closed path having a relatively longer, major axis and a relatively shorter, minor axis (which extends perpendicular to the major axis). The length of the major axis may be adjusted by changing the crank extension 166, as discussed above, and/or by changing the distance between the pivot axis H and the pivotal connections between the intermediate links 195 and respective handlebar rocker links 190.

The machine 100 may be considered advantageous to the extent that both the footprint of the machine 100 and the space needed for its operation are relatively small in comparison to the available stride length; the stride length is not necessarily limited by the diameter or stroke of the cranks; and/or the foot supports 150 may be positioned in close proximity to one another, thereby accommodating foot motion which may be considered a better approximation of real life activity. In this regard, the positions of the foot supports 150 (above the rails 120 and 130) eliminate the need for a frame supported bearing assembly between the foot supports 150.

The present invention has been described with reference to a preferred embodiment that will enable persons skilled in the art to recognize additional embodiments and/or applications which incorporate the essence of the present invention. Those skilled in the art will also recognize that the preferred embodiment may be modified in various ways without departing from the scope of the present invention. For example, various inertia altering devices, including a flywheel and/or resistance mechanisms may be added to the machine. Also, various linkage arrangements may be used to move the rails relative to the frame and/or the skates relative to the rails. With the foregoing in mind, the scope of the present invention is to be limited only to the extent of the following claims.

What is claimed is:

1. An exercise device, comprising:

a frame configured to rest on a floor surface;

first and second left rails pivotally mounted on the frame;

a left floating link pivotally interconnected between the left rails to define a left four bar linkage that maintains the left floating link in a fixed orientation relative to the frame;

a left foot support movably mounted on the left rails for movement along the left rails without changing orientation relative to the frame;

first and second right rails pivotally mounted on the frame;

a right floating link pivotally interconnected between the right rails to define a right four bar linkage that maintains the right floating link in a fixed orientation relative to the frame;

a right foot support movably mounted on the right rails for movement along the right rails without changing orientation relative to the frame;

a left crank and a right crank, wherein each said crank is rotatably mounted on the frame;

left and right first moving means interconnected between a respective said crank and a portion of a respective said four bar linkage that moves relative to the frame, for moving respective said rails relative to the frame; and left and right second moving means interconnected between a respective said crank and a respective said foot support, for moving said foot support relative to respective said rails.

2. The exercise device of claim 1, wherein each said first moving means includes at least one rigid link pivotally interconnected between a respective said crank and a respective said portion.

3. The exercise device of claim 1, wherein each said second moving means includes at least one rigid link pivotally interconnected between a respective said crank and a respective said foot support.

* * * * *